US005827576A

United States Patent [19]

Carter et al.

[11] Patent Number: 5,827,576

[45] Date of Patent: Oct. 27, 1998

[54] HOT DIP COATING METHOD AND APPARATUS

[75] Inventors: William A. Carter, Munster, Ind.; John A. Tanski, Los Alamos, N. Mex.; Ismael G. Saucedo, Valparaiso, Ind.; Howard L. Gerber, Chicago, Ill.

[73] Assignee: Inland Steel Company, Chicago, Ill.

[21] Appl. No.: 822,782

[22] Filed: Mar. 21, 1997

Related U.S. Application Data

[63] Continuation of Ser. No. 331,289, Oct. 28, 1994, abandoned, and a continuation of Ser. No. 118,013, Sep. 8, 1993, abandoned.

[51] Int. Cl.[6] ..... B05D 1/18

[52] U.S. Cl. ..... 427/436; 118/423; 118/419; 427/435

[58] Field of Search ..... 118/423, 419, 118/63, 429; 427/436, 435, 349, 383.1

[56] References Cited

U.S. PATENT DOCUMENTS

| | | | |
|---|---|---|---|
| 3,227,577 | 1/1966 | Baessler et al. | 118/405 |
| 5,197,534 | 3/1993 | Gerber et al. | 164/467 |

FOREIGN PATENT DOCUMENTS

| | | |
|---|---|---|
| 42 08 577 | 9/1993 | Germany . |
| 42 08 578 | 9/1993 | Germany . |
| 3-79747 | 4/1991 | Japan . |
| 1661242 | 7/1992 | Russian Federation . |
| 1076491 | 3/1982 | U.S.S.R. . |
| 1068535 | 1/1984 | U.S.S.R. . |
| 1096304 | 6/1984 | U.S.S.R. . |
| 1211335 | 2/1986 | U.S.S.R. . |
| 1217922 | 3/1986 | U.S.S.R. . |

OTHER PUBLICATIONS

Magnetohydrodevices for Metallurgical Industry, Proceedings of the Sixth International Iron and Steel Congress, 1990, Nagoya, ISIJ, pp. 333–337.

Development of Units for Hot Metallization from Melt on Long Steelrolled Stocks on Through–Passage Furnace with MHD–Stoppers, Birger, et al., Conference Proceedings—Corrosion Control—7th APCCC, vol. 2, 1991, pp. 1380–1382.

*Primary Examiner*—Brenda A. Lamb

*Attorney, Agent, or Firm*—Marshall, O'Toole, Gerstein, Murray & Borun

[57] ABSTRACT

A hot dip coating apparatus and method for coating a continuous steel strip, wire, or like continuous member with zinc, aluminum, tin, lead, or alloys of each. A molten coating bath is contained in a vessel having a bottom opening upwardly through which the steel member is directed. Magnetic containment devices located below the vessel's bottom opening prevent the escape of molten metal from the vessel through the opening. There are no guide rolls, or other rolls that act on the continuous steel member, in the bath.

80 Claims, 7 Drawing Sheets

HOT DIP COATING METHOD AND APPARATUS

CROSS-RERERENCE TO RELATED APPLICATION

This is a continuation of U.S. application Ser. No. 08/331,289, filed Oct. 28, 1994, now abandoned, in turn a continuation of U.S. application, Ser. No. 08/118,013, filed Sep. 8, 1993 and now abandoned.

BACKGROUND OF THE INVENTION

The present invention relates generally to the hot dip coating of steel strip and more particularly to the hot dip coating of steel strip with a molten coating metal selected from a group including zinc, aluminum, tin, lead, and alloys of each.

Steel strip is coated with one of the coating metals described above to improve the resistance of the steel strip to corrosion or oxidation. One procedure for coating steel strip with a coating metal is the hot dip procedure in which the steel strip is dipped in a bath of molten coating metal. The conventional hot dip procedure is continuous and requires, as a preliminary processing step, pre-treating the steel strip before the strip is coated with the coating metal. This improves the adherence of the coating to the steel strip. The pre-treating step can be either (a) a preliminary heating operation in a controlled atmosphere or (b) a fluxing operation in which the strip surface is conditioned with an inorganic flux.

Whether the pre-treating step involves heating in a controlled atmosphere or fluxing, the hot dip coating step per se takes place in a bath of molten coating metal containing submerged guide rolls for changing the direction of the steel strip or otherwise guiding the strip as it undergoes the hot dip coating step. More particularly, the steel strip normally enters the bath of molten coating metal in a direction having a substantially downward component and then passes around one or more submerged guide rolls that change the direction of the steel strip from substantially downward to substantially upward. The strip is then withdrawn from the bath of molten coating metal as the strip moves in the upward direction.

Problems arise due to the guide rolls being submerged in the bath of molten coating metal. A submerged guide roll operates under conditions which subject the guide roll surface to factors, such as wear and corrosion, which distort the surface of the guide roll. This in turn can result in distortion of a strip engaged by the guide roll, thereby ruining the strip.

Another drawback arising from the use of submerged guide rolls is the need to provide a coating bath of relatively large volume in order to submerge the guide rolls. To prevent the steel strip from being damaged or distorted, the steel strip must undergo a gradual change of direction from downward to upward as the strip passes through the molten coating bath. In the case where a single guide roll is employed to change the direction of the moving strip, that guide roll must have a relatively large radius in order to assure a gradual change of direction. In the case where a plurality of guide rolls are used to change the direction of movement of the strip from (a) initially predominantly downward movement to (b) horizontal movement and then to (c) predominantly upward movement, the radius of each of these guide rolls must be equal to the roll radius that would have been employed had a single roll been used, and the rolls must be spaced apart approximately horizontally within the bath. If a guide roll, which directs the strip to undergo any of the above-described direction changes, has too small a radius, the strip will non-uniformly bend (discontinuously yield) and form undesirable creases. In either case, a substantial volume of coating metal is required in order to maintain the guide rolls submerged within the bath. In a conventional, hot dip, strip coating process, the coating bath may contain 100,000 lbs. (45,400 kg) or more of molten coating metal. Typically, hot dip coating baths hold about 330,000 to 500,000 lbs. (150,000 to 227,000 kg) of molten coating metal.

A molten coating bath having a relatively large volume is characterized by several disadvantages. For example, if a change in the composition of the molten coating bath is desired, this can only be done gradually (e.g. by dilution) and, because of the relatively large volume of the bath, such a gradual change may take a relatively long period of time (e.g., 24–48 hours). In addition, the larger the volume of the bath, the longer the time required to heat the bath up to the desired temperature, upon start-up.

Moreover, the larger the bath volume, the greater the period of time the steel strip will spend immersed in, and subjected to the temperature of, the molten coating bath. In a conventional, hot dip, strip coating process, the strip may be immersed in the bath for about 1 to about 7 seconds. Typically, for example, the strip is submerged in the molten coating metal over a length of about 10 feet (about 3 meters). At typical strip speeds of 100–400 feet per minute (about 30.5 to 122 meters per minute), the immersion time would be 1.5 to 6.3 seconds. The longer the period of immersion, the greater the extent of alloying between the iron in the steel strip and the zinc or aluminum in the molten coating metal, and that type of alloying, if uncontrolled, is undesirable. In conventional hot dip coating processes, alloying retardants are added to the molten coating bath to prevent alloying of the type described in the preceding sentence.

Because of the large volume of the molten coating bath, the vessel containing the bath cannot be readily drained during a shutdown of the coating process. Accordingly, that part of the strip that is in the molten coating bath during shutdown will undergo an undesirable amount of alloying and will be ruined. For example, if the time the strip remains stationary in a zinc molten coating bath is long enough, the strip will alloy all the way through the thickness of the strip (complete alloying). When this occurs, the strip becomes very brittle in the area of complete alloying and will break when moved. The separate parts of the broken strip then have to be rejoined, resulting in a loss of production time because the entire strip processing line is shut down during the rejoining operation.

Another problem that arises in hot dip coating processes is the formation of dross (oxidized coating metal) on the exposed surface of the molten coating bath. It is desirable to minimize the extent to which the dross is capable of contacting the surface of the steel strip as the strip enters and exits the molten coating bath. In conventional hot dip coating processes, this is usually accomplished by employing relatively elaborate devices that circulate the dross to prevent it from accumulating at locations where the dross could undergo substantial contact with the steel strip entering or exiting the molten coating bath. Another type of dross can also be present in the molten coating bath during hot dip coating. For example, when the molten coating bath is zinc or zinc alloy, iron, dissolved from the strip surface and iron fines, carried into the bath with the strip, react with the zinc in the bath to form particles of insoluble, iron-zinc, intermetallic compound. These particles are denser than the molten bath, and they settle to the bottom of the vessel containing the bath, forming there an undesirable sludge, which can be entrained in the molten metal of the coating, reducing the quality of the coating.

SUMMARY OF THE INVENTION

A method and apparatus in accordance with the present invention eliminates the drawbacks and disadvantages of the conventional hot dip coating procedures described above.

The present invention employs a relatively small volume of molten coating metal in a relatively shallow bath contained in a relatively small vessel from which all guide rolls and other strip-contacting rolls are excluded. The vessel has an opening through which the steel strip is directed through the shallow bath of molten coating metal. In the specific embodiment shown in the drawings, the vessel opening is provided in a bottom wall of the vessel and the steel strip is directed upwardly through the opening in the vessel bottom. It should be understood, however, that the steel strip can be directed horizontally through side openings in the vessel as well. In the preferred embodiment, a magnetic containment device, located adjacent to a vessel bottom opening, prevents the molten coating metal in the bath from escaping from the vessel through the opening. Spaced below the vessel bottom, outside the coating bath, is a guide roll for changing the direction of movement of the steel strip from movement in some direction other than vertically upward to movement in a substantially vertically upward direction, the direction of movement of the strip as it enters the molten coating bath from below.

The magnetic containment device is positioned directly below the opening in the vessel bottom and is sufficiently close to the opening so that the magnetic field generated by the magnetic containment device extends upwardly into the opening.

Because there are no guide rolls or other rolls within the vessel and because there is no need to maintain any such roll submerged within the molten coating bath, the volume of the bath and the size of the vessel containing the bath are relatively small compared to baths and vessels employed in processes wherein the guide rolls and other rolls are submerged in the molten coating bath.

All the other drawbacks and disadvantages which accompanied submerged rolls are also eliminated by the present invention. Roll life is extended substantially. Strip distortion resulting from roll wear or distortion is minimized.

Because the volume of the bath is relatively small, a change in composition can be accomplished relatively rapidly and readily. Because the volume of the bath is relatively small, the bath can be readily and rapidly drained from the vessel should a shutdown occur. Because the bath is relatively shallow, and because the strip passes through the bath in a vertically upward direction only, the time the strip spends in the bath, subjected to the temperature of the bath, is relatively short. As a result, the danger of over-alloying between a molten coating metal and the iron in the steel strip is virtually non-existent, and the need for incorporating a retarding agent in the molten coating bath is significantly reduced or eliminated.

The magnetic containment device performs functions in addition to preventing the escape of molten coating metal through the bottom opening in the vessel. The magnetic containment device also circulates molten coating metal, from the bottom opening, around within the bath, to create at the bottom opening a fresh, unoxidized, un-dross-covered molten coating metal surface for contact with the steel strip as the strip enters the bath through the bottom opening of the vessel. Further, the magnetic containment device dampens vibration of the moving steel strip and maintains the steel strip centered in a proper location for even coating on both sides, thereby improving coating uniformity.

Other features and advantages are inherent in the method and apparatus claimed and disclosed or will become apparent to those skilled in the art from the following detailed description in conjunction with the accompanying diagrammatic drawings.

DETAILED DESCRIPTION

Figure 1:
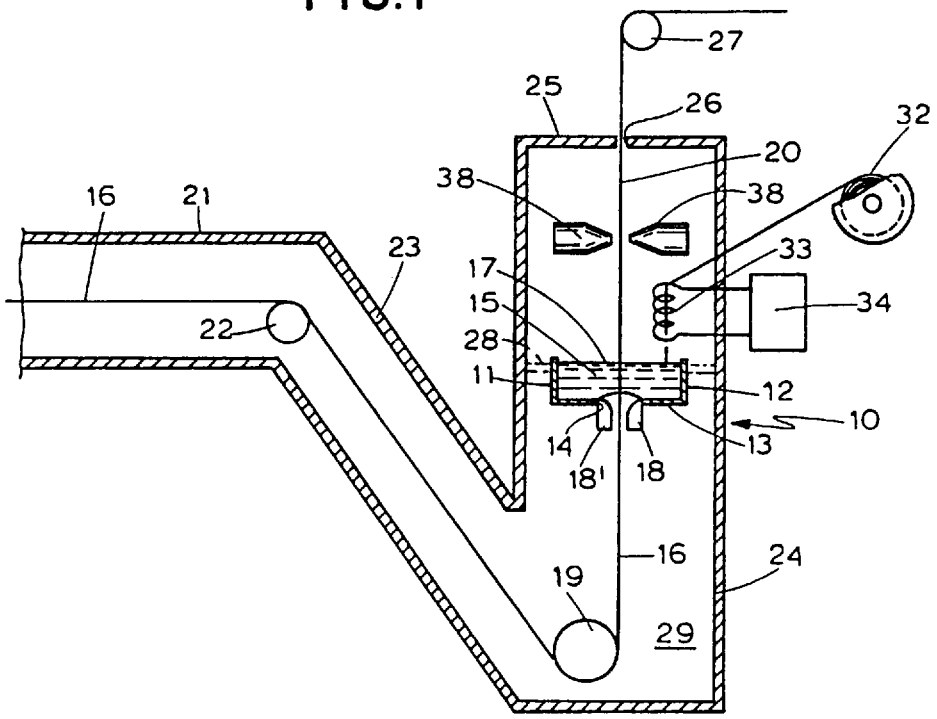
FIG. 1 is a vertical sectional view illustrating diagrammatically a method and apparatus in accordance with an embodiment of the present invention.

Referring initially to FIG. 1, indicated generally at 10 is an apparatus in accordance with an embodiment of the present invention for performing a method in accordance with an embodiment of the present invention. The apparatus and method are employed for hot dip coating a steel strip with a molten coating metal selected from a group including zinc, aluminum, tin, lead, and alloys of each. The following discussion is in the context of an example employing zinc as the coating metal, unless indicated otherwise.

Figure 6:
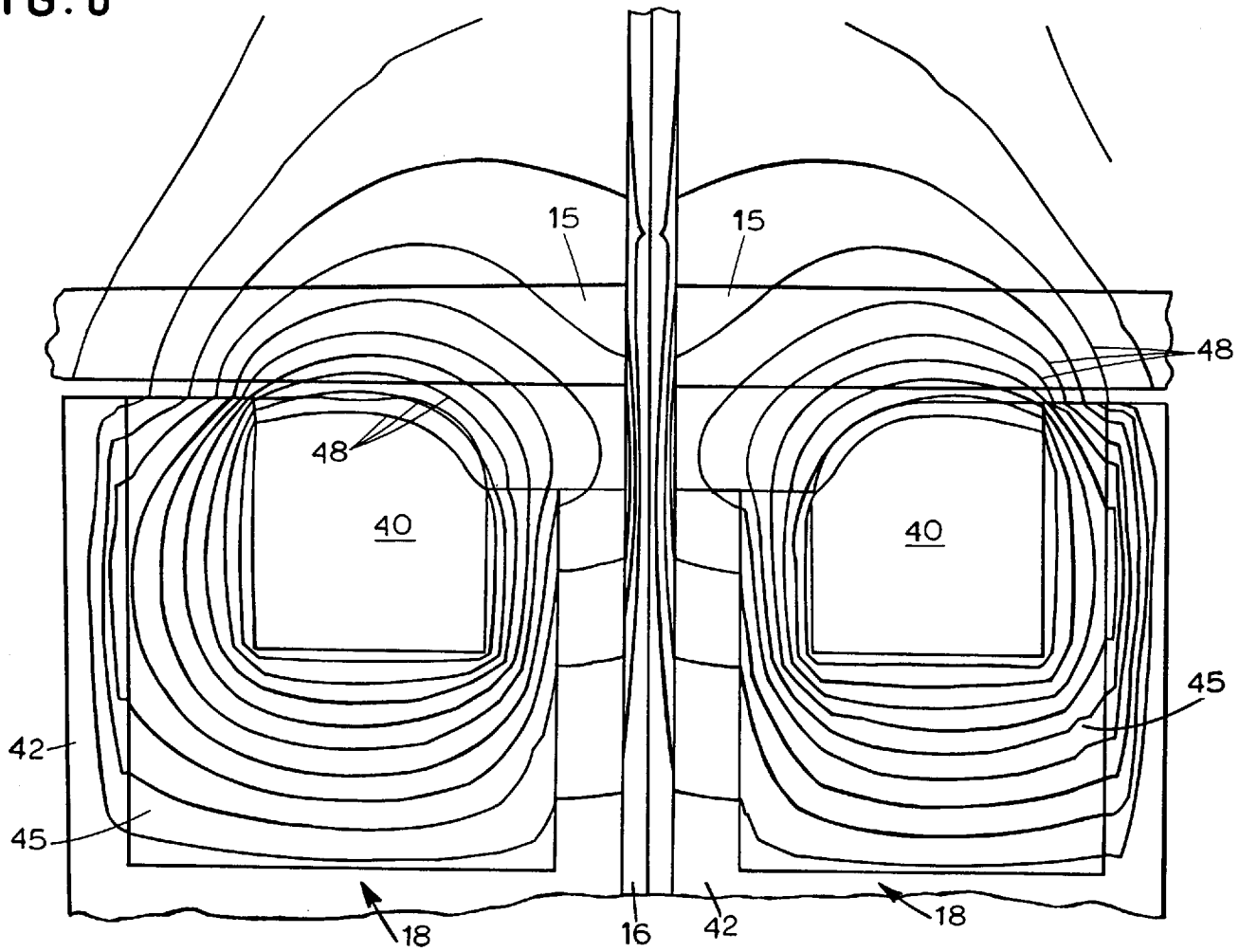
FIG. 6 is an enlarged, fragmentary, vertical sectional view illustrating diagrammatically the magnetic field generated by a magnetic containment device that may be utilized when employing a method or apparatus in accordance with the present invention.

Apparatus 10 comprises a vessel 11 for containing a bath 15 of molten coating metal. Vessel 11 comprises side walls 12 and a bottom 13 having an opening 14 upwardly through which is directed a steel strip 16. Steel strip 16 is directed upwardly through bath 15 to coat the strip with molten coating metal from the bath. Located adjacent to vessel bottom opening 14 is a magnetic containment structure for preventing the molten coating metal in bath 15 from escaping from vessel 11 through bottom opening 14. The magnetic containment structure comprises two identical magnetic containment devices 18, 18'. Each device 18, 18' is located on a respective opposite side of strip 16, in mirror image relation to the other device 18 (FIGS. 1 and 6).

As shown in FIGS. 1–2, 7 and 7A, steel strip 16 is directed along a strip path extending through vessel opening 14 and through bath 15 of the molten coating metal. This strip path has a first path part located outside of the vessel, adjacent opening 14, and a second path part located within bath 15. Magnetic containment devices 18, 18' face toward bath 15 through opening 14 and are positioned alongside the first path part.

Figure 2:
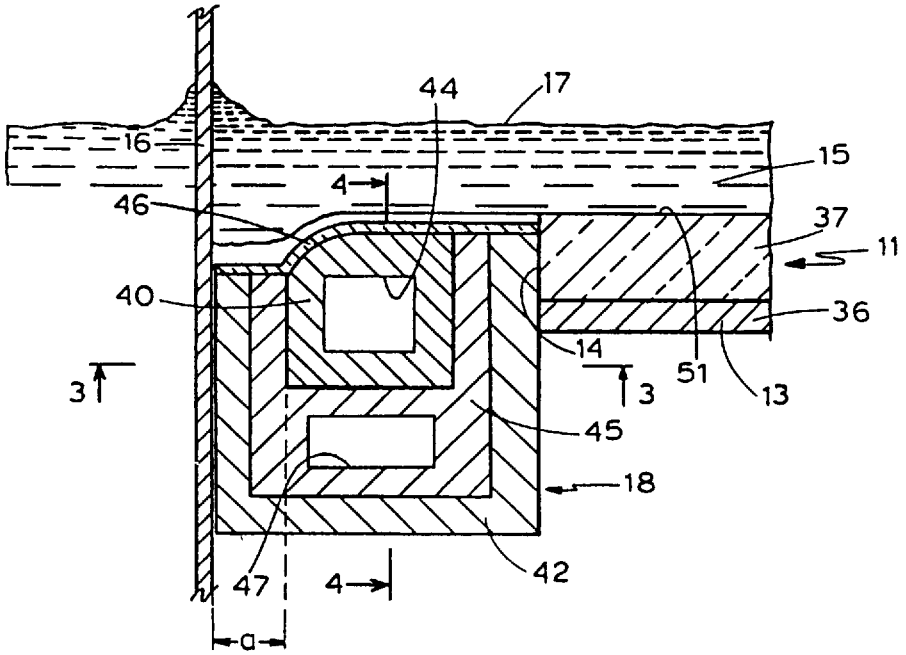
FIG. 2 is an enlarged, fragmentary view of a portion of the apparatus illustrated in FIG. 1.
Figure 2A:
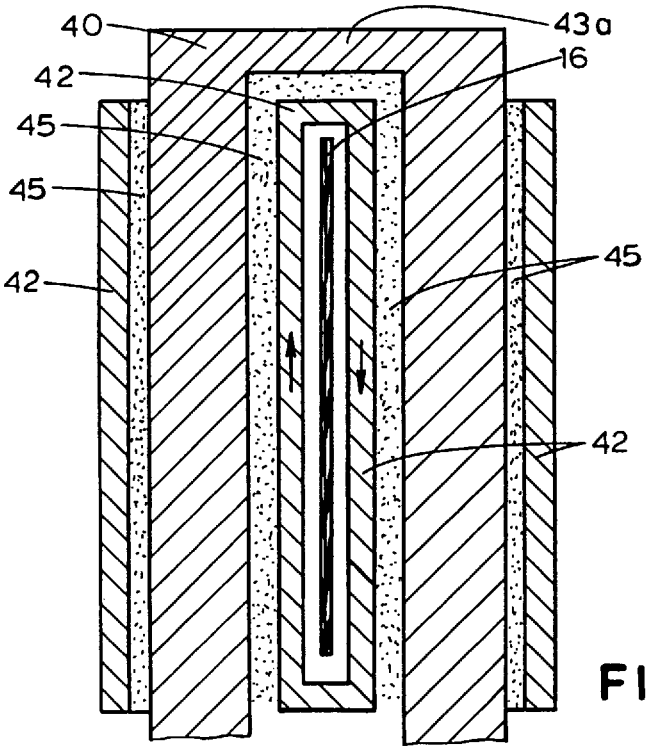
FIG. 2A is an enlarged, fragmentary top view of a portion of an embodiment of the apparatus illustrated in FIG. 1.
Figure 2B:
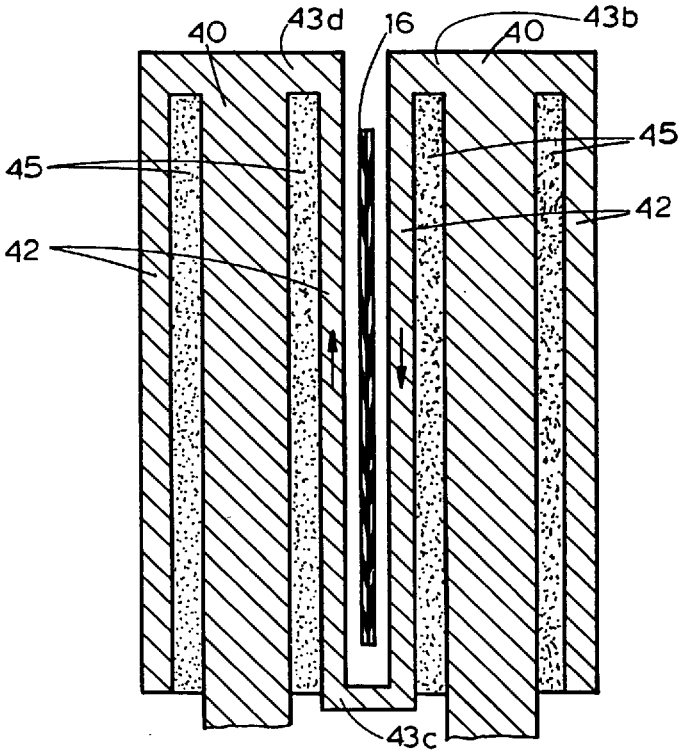
FIG. 2B is an enlarged, fragmentary top view, similar to FIG. 2A, showing another embodiment of a portion of the apparatus of FIG. 1.
Figure 3:
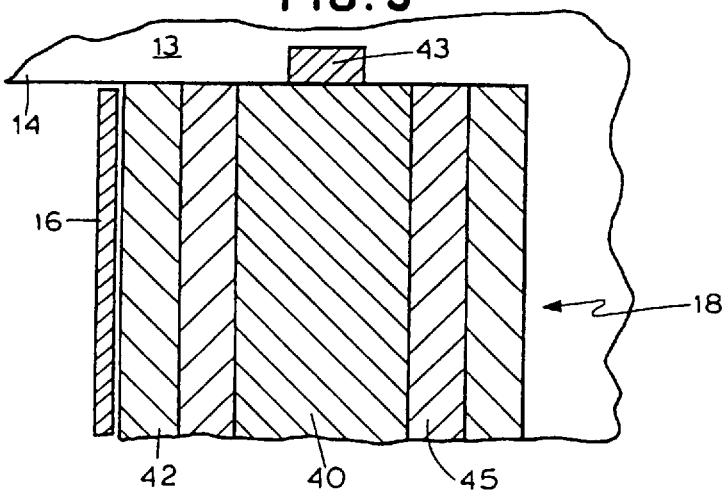
FIG. 3 is a sectional view taken along line 3—3 in FIG. 2.
Figure 4:
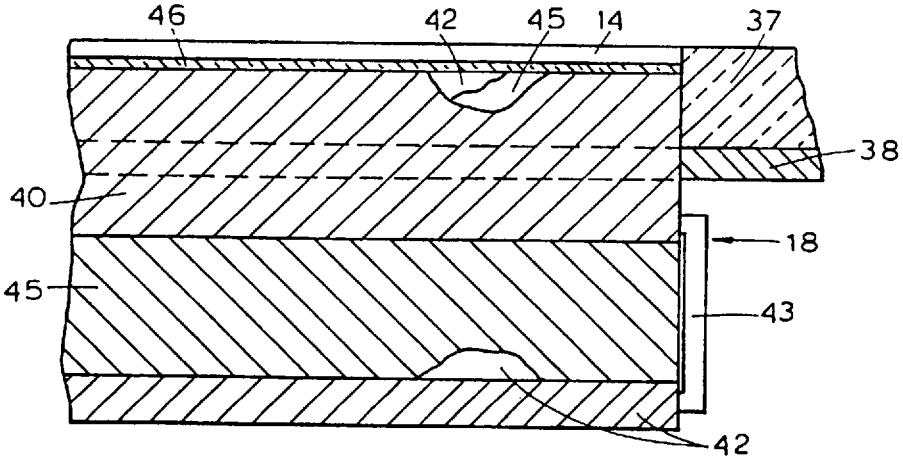
FIG. 4 is a sectional view taken along line 4—4 in FIG. 2.

As shown in FIGS. 2–4, vessel bottom opening 14 is in the form of a elongated slot comprising structure for receiving steel strip 16 as it moves upwardly through opening 14 into bath 15. As is apparent from FIGS. 2–4, vessel opening 14 has a cross-section, transverse to the path of steel strip 16, which is asymmetrical about the center point of the opening's cross-section, e.g. an elongated, rectangular cross-section. The strip path extends through the center point of the opening's cross-section. Magnetic containment devices 18, 18' are constructed to prevent molten coating metal from escaping through such an asymmetrically cross-sectioned opening. Strip 16 has a thickness and lateral and longitudinal dimensions (FIGS. 2, 2A, 2B and 3). Magnetic containment devices 18, 18' extend along the lateral dimension of strip 16 (FIG. 3). Steel strip 16 is directed upwardly by a guide roll 19 spaced below vessel bottom 13, outside molten coating bath 15. Guide roll 19 changes the direction of movement of steel strip 16 from movement in some direction other than vertically upward to movement in a substantially vertically upward direction.

Vessel 11 is devoid of any roll for directing or otherwise acting upon steel strip 16, at a location below the upper level 17 at which bath 15 is contained in vessel 11. More particularly, there are no guide rolls or other rolls within coating bath 15, whatsoever. Because there are no rolls submerged in bath 15, there is no diminution in a roll's operating life, as would occur for rolls submerged within the molten metal coating bath. Because no submerged rolls are used to guide or otherwise act on steel strip 16, when operating in accordance with the present invention, there is no distortion of a roll surface due to wear or metal build-up on the roll surface. As a result, distortion or other damage to the steel strip, which can occur when a roll surface is distorted, is minimized.

Located upstream of guide roll 19 is a pretreatment section or zone of which only the downstream part is shown at 21. A steel strip 16 which has undergone pre-treatment (to be described in more detail below) exits from downstream part 21 and, in the illustrated embodiment, is directed by an upper guide roll 22, along a path portion having a substantially downward component, toward lower guide roll 19. An enclosure 23 protects uncoated strip 16 from the outside atmosphere as it moves between upper guide roll 22 and lower guide roll 19. In other embodiments (not shown), strip 16 can approach lower guide roll 19 along a path portion which is substantially horizontal. A vertical enclosure 24 protects steel strip 16 from the outside atmosphere as it moves between lower guide roll 19 and opening 14 in vessel bottom 13. Vertical enclosure 24 may continue upwardly above vessel 11, terminating at a top wall 25 having an opening 26 through which a coated steel strip 20 passes. Located above top wall 25 is a further guide roll 27 for changing the direction of the coated steel strip from vertical to horizontal. It should be understood that the metal coating should be sufficiently solidified upon contacting guide roll 27 such that guide roll 27 does not mar the coated surface.

Located below top wall 25 are a pair of coating weight control knives 38, 38', one on each side of coated steel strip 20, for controlling the thickness of the coating metal on coated steel strip 20.

In another embodiment, vertical enclosure 24 may terminate at a lower top wall indicated in dash dot lines at 28. In this embodiment, the coated steel strip would be exposed to the outside atmosphere after it exited from molten coating bath 15. Whether vertical enclosure 24 terminates at higher top wall 25 or at lower top wall 28, in both embodiments vertical enclosure 24 encloses and protects, from the ambient atmosphere, an uncoated steel strip 16 directed upwardly through vessel bottom opening 14. In both embodiments, the vertical enclosure has a vertically disposed portion located below vessel 11 and has a bottom part 29 within which is located guide roll 19.

In the embodiment in which vertical enclosure 24 terminates at higher top wall 25, the vertical enclosure protects coated steel strip 20 from the ambient atmosphere at locations above vessel 11 and below top wall 25.

A further embodiment of vertical enclosure 24 may include both higher and lower top walls 25, 28. In this embodiment, the atmosphere in the space between lower top wall 28 and upper top wall 25 may be different from both the ambient atmosphere and the atmosphere below lower top wall 28.

The molten coating metal in bath 15 can be replenished with solid metal in the form of bars, ingots, rods, or wire, which are melted in the bath, or the bath metal can be replenished with fresh molten metal, pre-melted elsewhere.

In the illustrated embodiment, the molten coating metal in bath 15 is replenished by metal from a wire 31 drawn from a spool of wire 32. Wire 31 is fed or directed downwardly by guide rolls (not shown), through a vertically disposed induction heating coil 33, located directly above vessel 11, for heating the wire to a desired temperature, or its melting point. Electric current from a current source 34 flows through induction heating coil 33. As wire 31 is fed downwardly through heating coil 33, the wire is melted. The vertical disposition of heating coil 33 directly above bath 15 and the feeding of wire 31 vertically downwardly through heating coil 33 allows melted coating metal from wire 31 to drop into bath 15 in vessel 11. While the drawings illustrate metal replenishment via wire 31 to illustrate the flexibility in terms of a minimum molten metal bath and quick change-over features, it should be understood that the replenishing metal can be in any form, such as in the form of a metal bar, ingot, or slab, in addition to wire 31.

Wire 31 can have the same composition as bath 15, or wire 31 can have a composition different than that of bath 15 when it is desired to change the composition of bath 15. Because bath 15 has a relatively small volume and because the molten metal in bath 15 is depleted relatively rapidly as a steel strip 16 undergoes coating during its movement through bath 15, a substantial change in the composition of bath 15 can be accomplished relatively rapidly by replenishing the bath with a wire 31 having a composition which differs from that of bath 15. An example of a substantial change in the composition of a predominantly zinc bath is a change from (a) about 5 wt. % aluminum to (b) about 0.1 wt.

% aluminum. To accomplish this change, one would substitute, for a spool of replenishing wire having (a) the former composition, a spool of replenishing wire having (b) the latter composition. Other information relevant to an example of a rapid change in composition is set forth below.

In a typical embodiment of the present invention, vessel 11 is sized to contain a maximum quantity of molten coating metal, e.g., zinc or aluminum, of less than 1000 lbs. (454 kg), typically a quantity in the range of about 30–500 lbs. (about 13.6 to 227 kg). These amounts can be substantially different for metals of different densities. The following Table I shows the amount of molten coating metal in a typical vessel 11 when the metal bath is at 1 inch (2.54 cm) and 6 inches (15.24 cm) depths, and the bath has dimensions of 4 inches (10.16 cm) by 80 inches (2.03 meters) (the interior dimensions of the vessel or pot):

TABLE 1

LIQUID METAL IN MOLTEN COATING BATH

| BATH DIMENSIONS (IN.) | BATH VOLUME ($IN^3$) | BATH MASS ZINC (LB) | BATH MASS ALUMINUM (LB) |
|---|---|---|---|
| 80 × 4 × 1 (depth) | 320 | 82 | 31 |
| 80 × 4 × 6 (depth) | 1920 | 494 | 187 |

Steel strip 16 is directed upwardly through bath 15 at a conventional commercial coating rate, typically in the range 2.5–5 ft./sec. (76–152 cm/sec.). Typical dimensions for commercial coils of steel strip subjected to a continuous coating process are: width, 24–72 inches (61–183 cm); and thickness, 0.020–0.10 inches (0.51–2.54 mm). The coils may have a weight in the range 20,000–40,000 lbs. (9,080–18,160 kg). Conceivably, the coils can have a length in the range 800–24,000 feet (244–7,315 m), depending upon the coil weight and other coil dimensions.

When wire 31 has a composition different than that of bath 15, the employment of the above-described replenishing step in combination with the relatively small volume of bath 15 permits the normal operation of a coating method and apparatus in accordance with the present invention to effect a substantial change in the composition of bath 15 in substantially less than one hour (e.g., 10 minutes or less).

Conventional hot dip coating methods utilize a molten coating bath having a quantity of molten coating metal typically in excess of 100,000 lbs. (45,400 kg), e.g., 150,000 to 227,000 kg, so that a change in bath composition can take 24 to 48 hours compared to substantially less than one hour when utilizing a method and apparatus in accordance with the present invention.

Wire spool 32 is readily replaceable with wire spools having different compositions to enable various changes in the composition of bath 15.

One may employ more than a single replenishing wire 31 and more than a single induction heating coil 33, with the various wires being fed from their respective spools at different respective rates when it is desired to subject bath 15 to a change in composition.

Bath 15 typically has a depth of about 1–6 inches (2.54–15.24 cm), preferably 1–2 inches (2.54–5.08 cm). This allows one to limit the length of time in which strip 16 is immersed in bath 15 to less than one second, when the strip is moved through the bath at the typical commercial coating rate described above (2.5–5 ft./sec. (76–152 cm/sec.)).

If the replenishing step, employing the melting of wire 31 to replenish bath 15, is interrupted and the coating of steel strip 16 is continued while replenishing has been interrupted, the amount of coating metal in bath 15 will be depleted relatively rapidly, enabling one to empty vessel 11 of coating metal in 2 to 5 minutes, for example. An emptying time in this range assumes a bath weight of 30–500 lbs. (13.6–227 kg) and a strip coating rate of 2.5–5 ft./sec. (76–152 cm/sec.) and a strip width of 24–72 inches (61–183 cm), all of which were described above as exemplary of conditions employed in accordance with the present invention.

The time to empty vessel 11 will be dependent upon the strip speed, coating weight, strip width, and bath volume. The formula is:

$$t = 49.5 \times \frac{B}{LS \times SW \times CW}$$

Where:

t=time to empty pot (minutes)
B=bath volume (cubic inches)
LS=line speed (fpm)
SW=strip width (inches)
CW=coating weight (oz/sq ft, total both sides)

For the slowest emptying case, for zinc:

B=1920 cubic inches
LS=100 fpm
SW=24 inches
CW=0.3 oz/sq ft.
t=132 minutes

For the fastest emptying case, for zinc.

B=320 cubic inches
LS=400 fpm
SW=72 inches
CW=0.8 oz/sq ft.
t=0.7 minutes

As an example, the replenishment rate formula for zinc is as follows:

$$R=0.00523 \times LS \times SW \times CW$$

Where:

R=replenishment rate (lbs zinc/minute) Because vessel 11 can be emptied in such a relatively short time during shutdown (e.g., 2–5 minutes), the serviceability of vessel 11 and of the associated equipment in apparatus 10 is greatly improved.

If desired, vessel bottom 13 can be sloped toward vessel bottom opening 14 to facilitate drainage of bath 15 from vessel 11 during shutdown of the coating operation. Bath 15 can be drained from vessel 11 through bottom opening 14 by interrupting or discontinuing the operation of magnetic containment device 18 which normally prevents the escape of molten metal through vessel bottom opening 14. The operation of magnetic containment device 18 can be interrupted or discontinued merely by interrupting or discontinuing the flow of current through the coil (described below) that generates the magnetic field.

Alternatively, vessel 11 can be provided with a normally plugged drainage opening (not shown) at another location on the vessel bottom and the interior of the vessel bottom can be sloped toward the alternative drainage opening, which can be unplugged to drain the relatively small bath volume from vessel 11 during a shutdown. With this alternative arrangement, magnetic containment device 18 need not be removed from its location underlying vessel bottom opening 14, and device 18 will remain in operation until vessel 11 is substantially completely drained.

As noted above, the time in which steel strip 16 is immersed in bath 15 is typically less than 1 second. Because strip 16 is immersed in bath 15 for so short a period of time and because the immersed steel strip is subjected to the temperature of bath 15 for such a short period of time, there will be no significant alloying between the molten coating metal and the iron in strip 16. As a result, one may exclude from bath 15 most or all of any ingredient that is normally employed to retard alloying between the molten coating metal and the iron in steel strip 16. Typical retarding agents would be aluminum when bath 15 is composed of zinc and silicon when bath 15 is composed of aluminum.

As noted above, steel strip 16 is typically subjected to a conventional pre-treating operation before the strip is coated. In one conventional pre-treating operation, the steel strip is subjected to a cleaning step, followed by a rinsing step and a drying step. Optionally, the steel strip can be subjected to a flash coating step during which a flash coat of nickel or copper is applied to the strip, before the drying step. After drying, the steel strip is heated in a furnace under a reducing atmosphere, and that atmosphere is maintained until the strip is introduced into the molten coating bath. The enclosure depicted at 21, 23, and 24 in FIG. 1 maintains the desired atmosphere around strip 16 after it has been heated. Typically, the atmosphere in the enclosure depicted at 21, 23, and 24, up to at least lower top wall 28, may be a hydrogen/nitrogen atmosphere, whereas the atmosphere above lower top wall 28, i.e. between the top of vessel 11 and higher top wall 25, could be nitrogen alone. If wall 28 completely seals the area above molten metal-containing vessel 11 from therebelow, the atmosphere above the vessel 11 can be air.

Another embodiment of a conventional pre-treating operation dispenses with heating the steel strip in a reducing atmosphere. Instead, after the rinsing step, the strip is passed through a fluxing bath and then dried, following which the steel strip is introduced into the molten coating bath. When a fluxing type of pre-treating operation is employed, there is no need to protect the steel strip from the outside atmosphere upstream of the molten coating bath at 15. The magnetic field at vessel bottom opening 14 supplies the energy required to heat strip 16 sufficiently to activate the flux to clean the surface of the strip to enable adherence of the coating.

As noted above, the two types of pre-treating operations to which the steel strip may be subjected are conventional; the details thereof are well known to those skilled in the art of hot dip coating of steel strip.

Although not shown in FIG. 1, conventional drive rolls are employed for moving steel strip 16 along the processing path comprising the pre-treating operation and the coating operation depicted in FIG. 1.

In one type of pre-treating operation employing heating of the steel strip in a reducing atmosphere, interruptible induction heating may be employed to rapidly heat the steel strip anywhere upstream of vessel 11, e.g. upstream of upper guide roll 22 (located in enclosure 21). When induction heating is employed in the pre-treating operation, in combination with a method in accordance with the present invention, a drop in demand for coated strip can be accommodated by shutting down both (a) the pre-treating operation including the interruptible induction heating step and (b) all of the steps in the hot dip coating operation of the present invention. Such a shutdown may include draining molten coating bath 15 from vessel 11, utilizing any of the rapid drainage procedures described above. Eventually, when there is an increase in demand for coated strip, one may resume all of the processing steps, both (a) pre-treating and (b) hot dip coating in accordance with the present invention. There is a relatively small amount of molten coating metal in bath 15 (e.g. 67–500 lbs. (30–227 kg)); therefore, even if the bath had been drained from vessel 11 during shutdown, the vessel can be rapidly refilled with the required amount of molten coating metal when it is desired to resume hot dip coating in response to an increase in demand for coated metal strip.

A hot dip coated steel product resulting from performance of a method in accordance with the present invention comprises a steel base and a hot dip coating metal on the steel base. The coating metal may be selected from the group consisting of zinc, aluminum, tin, lead, and alloys of each. The product is characterized by the absence of (a) any substantial amount of intermetallic compound composed of iron and the coating metal and (b) any ingredient for retarding the formation of such an intermetallic compound.

Referring now to FIGS. 2–6, there will now be described an embodiment of a magnetic containment device 18 which may be employed in an apparatus or method incorporating the present invention.

As shown in FIG. 2, vessel bottom 13 comprises an exterior steel shell 36 and an interior refractory lining 37 and has a horizontal top surface 51. In the embodiment shown in FIG. 2, each magnetic containment device 18 extends upwardly above the lower extremity of vessel bottom opening 14 but is located below the upper extremity of opening 14. The vertical positioning of magnetic containment device 18 relative to vessel bottom opening 14 can be varied from the position shown in FIG. 2 so long as magnetic containment device 18 is positioned directly below opening 14 and sufficiently close to that opening so that the magnetic field generated by magnetic containment device 18 extends upwardly into opening 14 and prevents the molten metal from bath 15 from escaping from vessel 11 through opening 14. As shown in FIG. 2, the magnetic field generated by magnetic containment device 18 maintains bath 15 out of contact with magnetic containment device 18.

Thus, as shown in FIG. 2, bath 15 has a bottom 115 which is in contact with the top surface 51 of vessel bottom 13, but there is a gap 116 between (a) the top surface 118 of magnetic containment device 18 and (b) that part of bath bottom 115 which overlies magnetic containment device 18.

Figure 5:
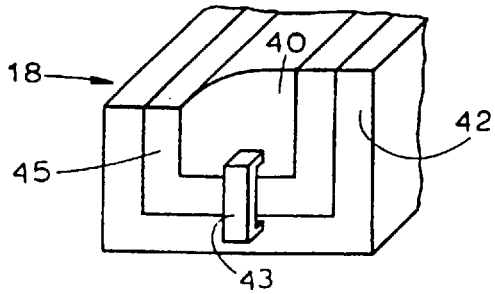
FIG. 5 is a fragmentary perspective of an embodiment of magnetic containment device which may be used in practicing the present invention.

Each magnetic containment device 18, 18' is in the form of a single-turn coil having a first coil portion 40 connected to a second coil portion or shield 42 by a conducting element 43 disposed at one end of magnetic containment device 18 (FIGS. 3–5). Coil portions 40 and 42 are cooled by flowing water, argon gas, or other cooling fluid through cooling channel 44. First and second coil portions 40, 42 and conducting element 43 are all composed of non-magnetic conducting material, such as copper.

Interposed between first coil portion 40 and second coil or shield portion 42 is a layer of magnetic material 45 of conventional composition, for example, any available ferrite materials and/or magnetic material 45 formed from cold rolled magnetic strip laminations. A thin film of electrical insulating material (not shown) is interposed between first coil portion 40 and magnetic layer 45 and also between magnetic layer 45 and second coil or shield portion 42. Interposed between the top of coil portions 40, 42 and magnetic material 45 of magnetic containment device 18 and the bottom of molten metal bath 15 is a layer 46 of refractory material which is part of and protects magnetic containment device 18 from the heat of molten metal bath 15 (FIG. 2).

Current from an external source may be introduced into first coil portion 40, and this current flows through first coil portion 40, then through conducting element 43, then through second coil or shield portion 42 and out of the coil and back to the external source of current. Magnetic containment device 18 generates a magnetic field shown representationally in FIG. 6 with streamlines 48 that indicate the direction of the magnetic field. The magnetic field represented by stream-lines 48 extends from magnetic containment device 18 inwardly through the opening in the vessel containing bath 15 and in the direction in which strip 16 moves along its path (upwardly in FIGS. 2 and 6). In each magnetic containment device 18, the layer 45 of magnetic material provides a low reluctance return path for the magnetic field generated by the coil composed of coil portions 40, 42, and 43.

Second coil portion 42 and the layer 45 of magnetic material are both U-shaped. U-shaped second coil portion 42 acts as a shield to confine the magnetic field substantially to the space at opening 14 between the top of magnetic containment device 18 and the bottom of molten coating bath 15. Magnetic layer 45 also includes a cooling channel 47 that, in a preferred embodiment, also receives water, argon gas, or other cooling fluid.

While some heating of the steel strip by the alternating current used in the electromagnetic-assisted coating method and apparatus of the present invention is advantageous, too much strip heating is disadvantageous. The magnetic field absorbed by and passing through the steel strip 16 is determined by the size of the gap "a" (FIG. 2).

As noted above, FIG. 6 is representational. For example, there is normally a space between steel strip 16 and the adjacent surface of second coil portion 42, of, e.g.,0.01 inch to about 1 inch, preferably less than ½ inch, to prevent damage to the steel strip 16 and to the magnet 18 that might be caused by contact of the strip 16 against the magnet 18. No such space is shown in FIG. 6. In addition, refractory material 46 is not shown in FIG. 6.

As noted four paragraphs above, in the embodiment illustrated in FIGS. 3–5 the current flow is separate for each device 18 on a respective opposite side of strip 16. In each such device 18, a separate current stream flows from an external source into first coil portion 40 then through connective conducting element or short 43 into second coil or shield portion 42 and then out of the coil back to the external source.

In the embodiment of FIG. 2B, the same current stream flows in series through the coil portions 40 and strip-adjusted parts of shield portions 42 on both sides of strip 16. More particularly, as shown by the arrows in FIG. 2B, a single current stream from an external source flows through first coil portion 40 on one side of strip 16 (to the right as viewed in FIG. 2B) and then through a first short 43*b* into that part of second coil or shield portion 42 adjacent strip 16. From there the current stream flows through a second short 43*c* into the strip-adjacent part of the shield portion 42 on the other side of strip 16 and from there through a third short 43*d* into the first coil portion 40 on the corresponding side of strip 16 and thence back to the external source.

In the embodiment of FIG. 2A, the first portions 40 on respective opposite sides of strip 16 are electrically connected to an external source at one end and shorted by 43*a* at their other end to form a U-shaped circuit or coil. The strip-adjacent parts of shield portions 42 are electrically connected at both opposite ends to form a conductive loop around strip 16. The current flow in this loop, shown by the arrows in FIG. 2A is induced by the current flow in the U-shaped circuit defined by the two first portions 40 and short 43*a*. Current from the external source which enters that one end of first portion 40 which is on the right side of strip 16 (as in the embodiment of FIG. 2B) flows sequentially through that first portion 40, through short 43*a* into first portion 40 on the other side of strip 16 and thence back to the external source. The direction of induced current flow in the loop depicted by the arrows in FIG. 2A, reflects the current flow, through the two first portions 40, described in the preceding sentence.

Additional information on the structure and materials of construction for magnetic containment devices of the general type described above is contained in Gerber, et al. U.S. Pat. No. 5,197,534, and the relevant disclosure therein is incorporated herein by reference. As is evident from the foregoing discussion, in the illustrated embodiments the magnetic field generated by magnetic devices 18 is the sole expedient for preventing molten coating metal in bath 15 from escaping through vessel opening 14.

In addition to preventing the escape of molten metal through vessel bottom opening 14, magnetic containment device 18 performs additional functions; it circulates molten coating metal, from bottom opening 14, around within bath 15 to create, at bottom opening 14, a fresh, unoxidized, molten coating metal surface, devoid of a dross layer, for contact with uncoated steel strip 16 as the strip enters bath 15 through bottom opening 14. Moreover, the magnetic field, resulting from the employment of device 18, will also heat bath 15 and strip 16.

Figure 7A:
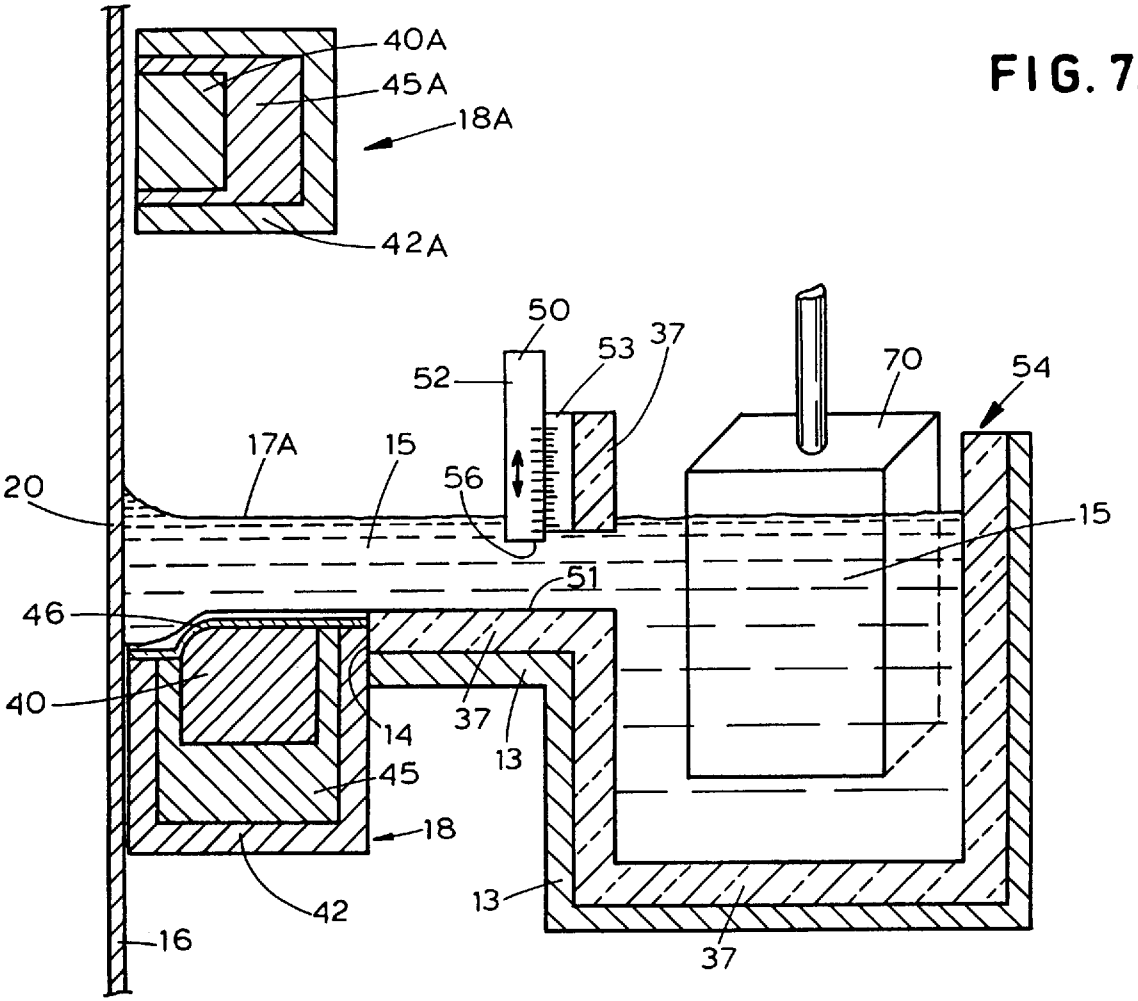
FIG. 7A is an enlarged, fragmentary, vertical view, similar to FIG. 7, illustrating means for easily and mechanically controlling the liquid level of the molten metal bath contacting the steel strip via partial or complete immersion of a molten metal displacement member.
Figures 7, 7B:
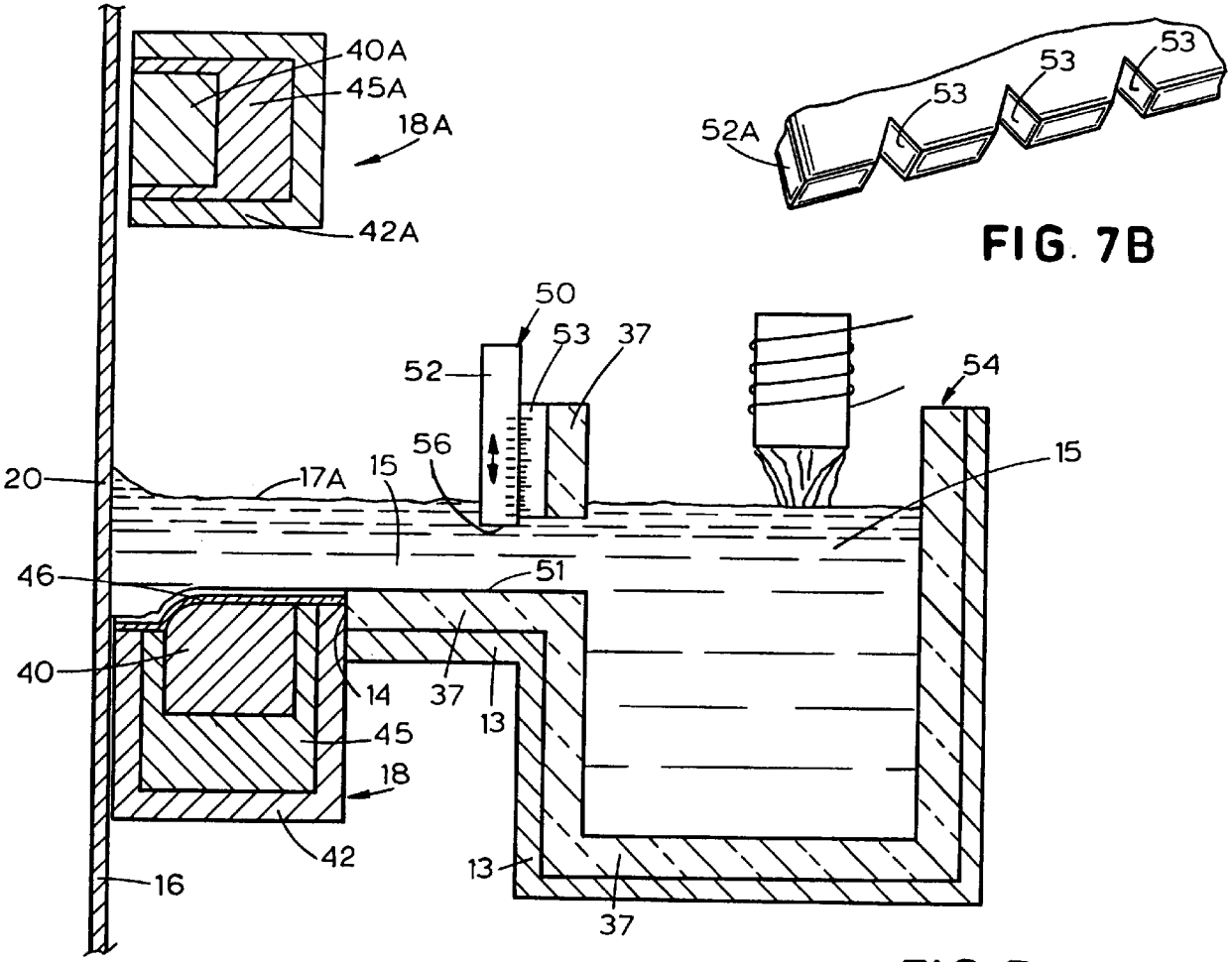
FIG. 7 is an enlarged, fragmentary view, similar to FIG. 2, illustrating two additional embodiments of the present invention, useful together or separately, including a molten metal flow control device and magnetic wiping of coated steel strip.
FIG. 7B is an enlarged, fragmentary, perspective view of an alternate flow control gate 52A, shown in FIG. 7.

In accordance with another embodiment of the present invention, as illustrated in FIG. 7, the apparatus and method previously described with reference to FIGS. 1–6 advantageously can be used in conjunction with a flow control and molten metal shut-off device 50. Each flow control device 50 includes a vertically adjustable molten metal-impermeable wall or gate 52 adjustably mounted to a stationary supply vessel support wall 53. A level control device 50 is disposed on each side of the coated steel strip 20 between the coated steel strip 20 and an integral, optionally modular, molten metal supply vessel 54. Each flow control device 50 provides for quick adjustment of the flow rate of molten metal in contact with each side of the steel strip. Gate 52 of each level control device 50 can be vertically adjusted equally with respect to its supply vessel vertical wall 53, change the size of a molten metal outlet 56 defined between gate 52 and horizontal top surface 51 of vessel bottom 13.

The gate 52 of flow control device 50 is movably mounted to supply vessel wall 53 to adjustably define the flow rate of molten metal from molten metal supply vessel 54 to the steel strip 16. Molten metal outlet 56 leads molten metal from molten metal supply vessel 54, over vessel bottom opening 14 to the steel strip 16, forming a molten metal flow path from molten metal supply vessel 54, over top surface 51, to the steel strip 16 above the magnetic confinement device 18. In the preferred embodiment, each flow control device 50, when gate 52 is completely closed, provides a molten metal-impermeable seal that completely blocks molten metal from following the flow path from vessel 54 to the steel strip 16. This gate closing feature is extremely advantageous for rapid changes in molten metal composition without completely using or draining the molten metal contained in vessel 54. When it is desirable to stop the coating operation, for whatever reason, the gate 52 can be completely lowered to seal opening 56, and the molten metal drained from the bottom opening (not shown) between the steel strip 16 and the flow control gate 52, as described with reference to FIGS. 1–6. The molten metal contained in vessel 54 can be adjusted in composition while the vessel is sealed before restarting the coating operation, or the vessel 54 can be exchanged for another vessel containing a molten metal of a different composition, as explained with reference to FIG. 8. In the embodiment shown in FIG. 7B, another form of the gate, indicated at 52A, includes notched openings 53 for controlled flow of molten metal from vessel 54 over horizontal wall 51, to the steel strip 16.

In accordance with another level control embodiment of the present invention, as illustrated in FIG. 7A, the molten metal level 17A can be adjusted quickly without addition of more metal to the molten metal bath 15, by partial or complete immersion of a mass of inert material 70 that is capable of withstanding the temperature of the molten metal when at least partially immersed therein to raise the molten metal level 17A. The inert mass 70 is large enough such that when completely withdrawn from the molten metal 15, essentially all molten metal in the horizontal flow path between vessel 54 and the steel strip 16 will flow back into vessel 54 (the level in vessel 54 will be below horizontal wall 51). The inert mass 70 can include a heating means, e.g., an electrical coil, integral within the mass to melt any metal therefrom, that might otherwise solidify on an outer surface of the mass 70, to maintain the mass 70 at a known volume for liquid level control. Upon partial immersion of the mass 70 into the molten metal bath 15, the level 17A will rise on both sides of wall 53, quickly, without additional metal added to bath 15.

In accordance with another important embodiment shown in FIG. 7, one or more additional magnetic containment devices 18A is used singly, or one above another, and each is disposed in close proximity to the coated steel strip above the molten metal bath 15 for the purpose of wiping excess coating metal from the surface of the coated steel strip 20 and forcing the excess metal back into the molten metal bath 15 of coating metal. As noted above, strip 16 is directed along a path having first and second parts which are upstream of additional magnetic devices 18A which, in turn, are positioned alongside a third path part located downstream of bath 15. Each magnetic containment (wiping) device 18A is constructed similar to magnetic containment device 18 in the form of a single-turn coil having a first coil portion 40A connected to a second coil portion 42A by a conducting element (not shown, but constructed the same as conducting element 43, FIGS. 3–5, of device 18). First and second coil portions 40A, 42A and the conducting element are all composed of non-magnetic conducting material, such as copper.

Interposed between first coil portion 40A and second coil or shield portion 42A is a layer of magnetic material 45A of conventional composition. A thin film of electrical insulating material (not shown) is interposed between first coil portion 40A and magnetic layer 45A and between magnetic layer 45A and coil portion 42A. The magnetic field, generated in the same manner described with reference to magnetic containment device 18, forces excess coating metal back toward the coating bath 15.

Figure 8:
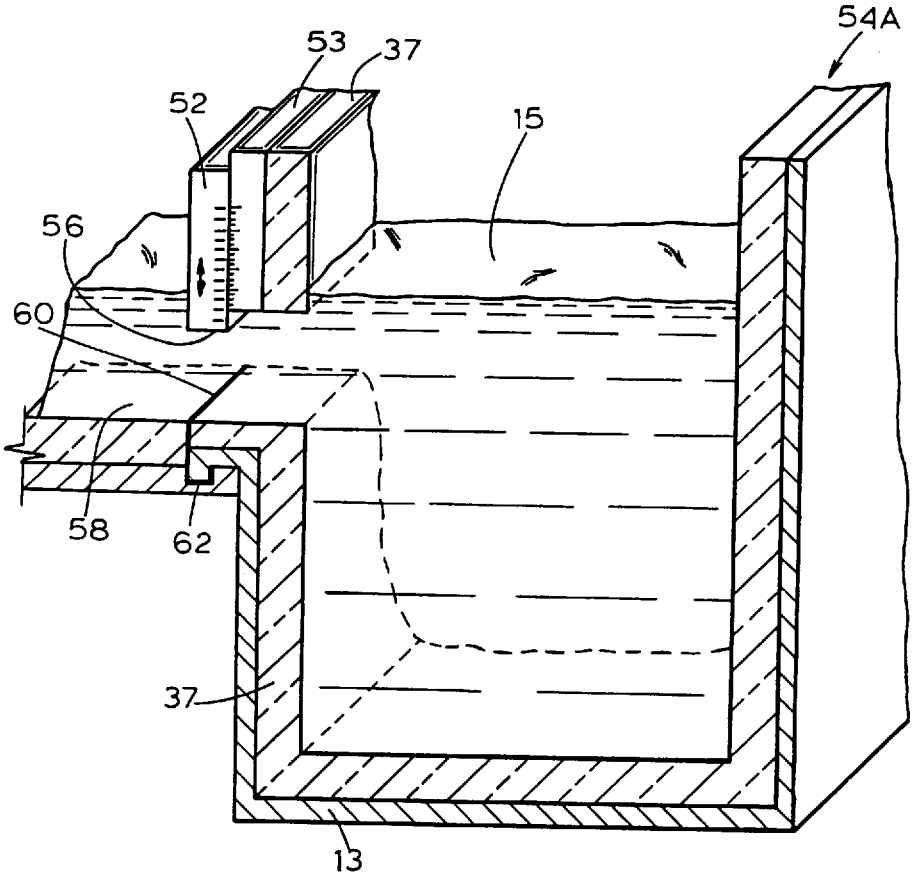
FIG. 8 is an enlarged, fragmentary perspective view illustrating another, modular molten metal supply vessel embodiment of the present invention.

As illustrated in FIG. 8, in accordance with one embodiment of the present invention, vessel 54A is constructed so that it can be removed from its metal flow path connecting structure 58 at high temperature seal 60 and substituted with another interconnectable vessel of like construction. The substituting vessel can be empty, for the addition of a molten metal of any desired composition, or the substituting vessel can contain a desired quantity of molten metal of desired composition upon installation, for rapid changeover from one molten metal composition to another. For the purpose of vessel changeover, as shown in FIG. 8, vessel 54A and metal flow path connecting structure 58 are formed to include a tongue and groove fitting 62 sealed at the interconnection between flow path structure 58 and vessel 54A with a sealing material capable of withstanding the molten metal temperature.

The continuous process and apparatus described above has been discussed in the context of hot dip coating steel strip. The process and apparatus can also be used to hot dip coat steel wire or a like continuous member, or to hot dip coat strip, wire, or a like continuous member composed of some other appropriate metal.

The foregoing detailed description has been given for clearness of understanding only and no unnecessary limitations should be understood therefrom, as modifications will be obvious to those skilled in the art.

What is claimed is:

1. In combination, an apparatus for hot dip coating a continuous steel member with a molten coating metal selected from a group including zinc, aluminum, tin, lead, and alloys of each, and a bath of said molten coating metal, said combination comprising:

a vessel containing said bath of molten coating metal;

an opening in said vessel;

means for directing a continuous steel member along a path extending through said opening in the vessel and through the bath of molten coating metal contained in said vessel to coat said member with said molten coating metal;

said path having a first part located outside of said vessel, adjacent said vessel opening, and a second part located within said bath;

and magnetic containment means, said magnetic containment means comprising means which faces toward said bath through said opening and which is positioned alongside said first part of said path, for preventing the molten coating metal in said bath from escaping from said vessel through said opening;

said magnetic containment means comprising means for generating a magnetic field which extends from said magnetic containment means inwardly through said opening in the vessel and maintains said bath out of contact with said magnetic containment means.

2. The combination as recited in claim 1, wherein:

said means for directing said continuous steel member comprises a guide roll for aligning the steel strip with said vessel opening; and said vessel being devoid of any guide roll, for directing said steel member, at a location below the upper level at which said bath of molten coating metal is contained in said vessel.

3. The combination as recited in claim 2, wherein:

there are no guide rolls within said coating bath, whatsoever.

4. The combination as recited in claim 1, wherein said member is a steel strip and wherein:

said vessel is sized to contain a maximum quantity of molten coating metal less than 1,000 pounds or 454 kilograms.

5. The combination as recited in claim 4, wherein:

said vessel is sized to contain a maximum quantity of molten coating metal in the range of about 67 to 500 pounds or 30 to 227 kilograms.

6. An apparatus as recited in claim 1, wherein the magnetic containment means comprises a magnetic coil including a first non-magnetic coil portion and a second non-magnetic coil portion spaced by an interposed magnetic material, said first and second coil portions being interconnected by a conductive means for electrically connecting said first and second coil portions, said magnetic material substantially enclosing said first coil portion, and said second coil portion substantially enclosing said magnetic material.

7. The combination as defined in claim 6 further including a first insulating means for electrically insulating said first coil portion from said interposed magnetic material and a second insulating means for electrically insulating said second coil portion from said interposed magnetic material.

8. The combination as defined in claim 6 further including electrical current means for introducing electrical current into said first coil portion to establish current flow from said first coil portion, through said conductive means, through said second coil portion, and back to the electrical current means.

9. The combination as defined in claim 6 further including a layer of,refractory material disposed between said magnetic containment means and said bath of molten coating metal to protect the magnetic containment means from the heat of the molten metal.

10. The combination as recited in claim 6, wherein the first coil portion includes an outer surface facing toward the bath of molten metal.

11. In the combination of claim 1 wherein:

said bath of molten coating metal is selected from a group consisting of zinc, aluminum, tin, lead, and alloys of each;

said bath being substantially devoid of any ingredient which retards alloying between said coating metal and the iron in said steel member.

12. The combination as recited in claim 1 wherein:

said opening in the vessel has a cross-section, transverse to said path, which is asymmetrical about the center point of said cross-section;

said path extends through said center point of the opening's cross-section;

and said magnetic containment means comprises means for preventing molten coating metal from escaping through such an asymmetrically cross-sectioned opening.

13. The combination as recited in claim 12 wherein:

said opening in the vessel is an elongated slot comprising means for receiving said member.

14. The combination as recited in claim 1 wherein:

said vessel has a plurality of side openings;

and said directing means comprises means for directing said steel member horizontally through said side openings.

15. The combination as recited in claim 1 wherein:

said path has a third part located downstream of said bath;

said apparatus further comprising additional magnetic containment means, positioned alongside said third part of said path, for wiping excess coating metal from the surface of said steel member;

said additional magnetic containment means comprising means for generating a magnetic field which forces said excess coating metal back toward said bath.

16. The combination as recited in claim 15 wherein:

no part of said apparatus is interposed between any of said magnetic containment means and said path.

17. The combination as recited in claim 1 wherein:

no part of said apparatus is interposed between said magnetic containment means and said path.

18. In combination, an apparatus for hot dip coating a continuous steel member with a molten coating metal selected from a group including zinc, aluminum, tin, lead, and alloys of each, and a bath of said molten coating metal, said combination comprising:

a vessel containing said bath of molten coating metal said vessel having side walls and a bottom;

an opening in said vessel bottom;

means for directing a continuous steel member upwardly along a path extending through said opening in the vessel bottom and through the bath of molten coating metal contained in said vessel to coat said strip with said molten coating metal;

said path having a first part located outside of said vessel, adjacent said vessel opening, and a second part located within said bath;

and magnetic containment means, said magnetic containment means comprising means which faces toward said bath through said opening and which is positioned alongside said first part of said path adjacent to said vessel bottom opening, for preventing the molten coating metal in said bath from escaping from said vessel through said opening;

said magnetic containment means comprising means for generating a magnetic field which extends from said magnetic containment means inwardly through said opening in the vessel and maintains said bath out of contact with said magnetic containment means.

19. The combination as recited in claim 18, wherein:

said means for directing said continuous steel member comprises a guide roll for changing the direction of movement of said member from movement in some direction other than vertically upward to movement in a substantially vertically upward direction, said guide roll being spaced below said vessel bottom, outside said coating bath;

said vessel being devoid of any guide roll, for directing said steel member, at a location below the upper level at which said bath of molten coating metal is contained in said vessel.

20. The combination as recited in claim 18, wherein:

said magnetic containment means is positioned directly below said opening in the vessel bottom and sufficiently close to said opening so that the magnetic field generated by said magnetic containment means extends upwardly into said opening.

21. The combination as recited in claim 18, wherein:

said opening in the vessel bottom is an elongated slot comprising means for receiving said member.

22. The combination as recited in claim 18 and comprising:

means, located below said vessel, for enclosing and protecting, from the ambient atmosphere, a steel member directed upwardly through said vessel bottom opening.

23. The combination as recited in claim 22 and comprising:

additional means, located above said vessel, for enclosing and protecting said member from the ambient atmosphere.

24. The combination as recited in claim 18 and comprising:

a furnace, located upstream of said vessel, for pre-treating said member;

means for moving said member along a path extending from said furnace to said opening in the vessel bottom;

and means for enclosing said member and protecting the member from the ambient atmosphere as the strip moves along said path.

25. The combination as recited in claim 24, wherein:

said enclosing means has a vertically disposed portion located below said vessel and having a bottom part;

and said apparatus comprises a guide roll located within said bottom part for directing said member upwardly toward said vessel.

26. The combination as recited in claim 18 and comprising:

means for replenishing the bath in said vessel with molten coating metal.

27. The combination as recited in claim 26, wherein said replenishing means comprises:

a heating coil located directly above said vessel;

means for feeding a solid metal source composed of said coating metal through said heating coil;

said heating coil comprising means for melting said solid metal source composed of coating metal, and for allowing melted coating metal to drop into said bath in said vessel.

28. The combination as recited in claim 27, wherein said solid metal source is metal wire.

29. The combination as recited in claim 27, wherein said solid metal source is a metal ingot.

30. The combination as recited in claim 26, wherein said member is a steel strip and said apparatus comprises:

means for coating said strip at a commercial coating rate in the range 2.5–5 feet/second or 76–152 centimeters/second and means, including said replenishing means and the internal volume of said vessel, for permitting the normal operation of said coating apparatus to effect a substantial change in the composition of said bath in substantially less than an hour, when coating a steel strip having a width in the range 24–72 inches 61–183 centimeters.

31. The combination as recited in claim 30, wherein said means for permitting a substantial change in bath composition comprises:

a heating coil located directly above said vessel;

means for feeding, through said heating coil, solid metal composed of a coating metal other than the metal composition of said bath;

said heating coil comprising means for melting said solid metal composed of coating metal, as the solid metal is contacted with said coil, and for allowing melted coating metal to drop into said bath in said vessel.

32. The combination as recited in claim 18, wherein:

said opening in the vessel bottom further comprises a means for draining molten metal from said vessel.

33. The combination as recited in claim 18 and comprising:

a drainage hole in a bottom of said vessel; the interior surface of said vessel bottom being sloped toward said drainage hole.

34. The combination as defined in claim 18, wherein the magnetic containment means comprises a magnetic coil including a first non-magnetic coil portion and a second non-magnetic coil portion spaced by an interposed magnetic material, said first and second coil portions being interconnected by a conductive means for electrically connecting said first and second coil portions.

35. The combination as defined in claim 34 further including a first insulating means for electrically insulating said first coil portion from said interposed magnetic material and a second insulating means for electrically insulating said second coil portion from said interposed magnetic material.

36. The combination as defined in claim 34 further including electrical current means for introducing electrical current into said first coil portion to establish current flow from said first coil portion, through said conductive means, through said second coil portion, and back to the electrical current means.

37. The combination as defined in claim 34 further including a layer of refractory material disposed between said magnetic containment means and said bath of molten coating metal to protect the magnetic containment means from the heat of the molten metal.

38. The combination as recited in claim 34, wherein the first coil portion includes an outer surface facing toward the bath of molten metal, said outer surface curving downwardly and inwardly toward said continuous steel member over a portion of said outer surface closest to said continuous steel member.

39. The combination as recited in claim 18 further including magnetic wiping means disposed adjacent to said continuous steel member and above the bath of molten coating metal for magnetically wiping excess coating metal from said coated steel member.

40. The combination as recited in claim 39, wherein the magnetic wiping means comprises a magnetic coil including a first non-magnetic coil portion and a second non-magnetic coil portion spaced by an interposed magnetic material, said first and second coil portions being interconnected by a conductive means for electrically connecting said first and second coil portions.

41. The combination as defined in claim 40 further including a first insulating means for electrically insulating said first coil portion of said wiping means from said interposed magnetic material of said wiping means and a second insulating means for electrically insulating said second coil portion of said wiping means from said interposed magnetic material.

42. The combination as defined in claim 40 further including electrical current means for introducing electrical current into said first coil portion of said wiping means to establish current flow from said first coil portion of said wiping means, through said conductive means, through said second coil portion of said wiping means, and back to the electrical current means.

43. The combination as recited in claim 40, wherein the first coil portion of said magnetic wiping means includes an exposed outer surface facing said coating metal on said continuous steel member, said exposed outer surface being essentially planar.

44. The combination as recited in claim 18, wherein said vessel further includes an upper molten metal outlet disposed above the vessel bottom and spaced from said steel member and providing a flow path for molten metal to said steel member over said vessel bottom opening.

45. The combination as recited in claim 44 further including depth means for adjusting the depth of molten metal emanating from said upper outlet toward said continuous steel member.

46. The combination as recited in claim 45, wherein said depth means comprises a mass at least partially submersible in said molten metal and controllably submersible to adjust said molten metal level.

47. The combination as recited in claim 44 further including means for closing said outlet.

48. The combination as recited in claim 44, wherein said vessel is separable into two sections so that upon closing said outlet, a first portion of said vessel, containing molten metal, can be displaced without spillage of molten metal from said closed first portion of said vessel and replaced with a vessel of like construction.

49. In the combination of claim 6 wherein:

said bath of molten coating metal is selected from a group consisting of zinc, aluminum, tin, lead, and alloys of each;

said bath being substantially devoid of any ingredient which retards alloying between said coating metal and the iron in said steel member.

50. The combination as recited in claim 1 or claim 18 wherein:

said magnetic field extends from said magnetic containment means in the direction in which said member moves along said path.

51. The combination as recited in claim 1 or claim 18 wherein said continuous steel member to be coated is a strip having a thickness and lateral and longitudinal dimensions, and wherein:

said magnetic containment means is elongated and extends longitudinally along said lateral dimension of said strip.

52. The combination as recited in claim 1 or claim 18 wherein:

said magnetic containment means comprises means for employing alternating current for generating said magnetic field.

53. The combination as recited in claim 52 wherein:

said magnetic field is the sole expedient for preventing said molten coating metal from escaping from the vessel through said opening.

54. The combination as recited in claim 1 or claim 18 wherein:

said magnetic field extends from said magnetic containment means in the direction in which said member moves along its path;

and said magnetic containment means comprises means for confining said magnetic field substantially to a space at said opening between (a) that part of said magnetic containment means closest to said bath and (b) the bath at said opening.

55. The combination as recited in claim 1 or claim 18 wherein:

said magnetic containment means comprises means for circulating molten coating metal, at said opening, around said opening within said bath to create at said opening a fresh, unoxidized, un-dross-covered molten coating metal surface for contact with said steel member as the member enters said bath through said opening.

56. A method for hot dip coating a continuous steel member with a molten coating metal selected from a group including zinc, aluminum, tin, lead, and alloys of each, to produce a coated steel strip, said method comprising the steps of:

providing a bath of said molten coating metal;

containing said bath of molten coating metal in a vessel having an opening therein;

directing a continuous steel member along a path extending through said opening in the vessel and through said bath of molten coating metal contained in said vessel to coat said member with said molten coating metal;

said path having a first part located outside of said vessel, adjacent said vessel opening, and a second part located within said bath;

and magnetically confining, within said vessel, the molten coating metal at said opening, to prevent the molten coating metal in said bath from escaping from said vessel through said opening;

said confining step comprising (a) providing magnetic containment means and positioning said magnetic containment means alongside said first path part, facing toward said bath through said opening, and (b) employing said magnetic containment means to generate a magnetic field which extends from said magnetic containment means inwardly through said opening in the vessel and maintains said bath out of contact with said magnetic containment means.

57. A method as recited in claim 56 and comprising:

employing said magnetic containment means to circulate molten coating metal, at said opening, around said opening within said bath to create at said opening a fresh, unoxidized, un-dross-covered molten coating metal surface for contact with said steel member as the member enters said bath through said opening.

58. A method as recited in claim 56, wherein said vessel has a bottom, said opening is in said vessel bottom and said directing step comprises:

directing said member upwardly through said opening;

changing the direction of movement of said steel member from (a) movement in some direction other than vertically upward to (b) movement in a substantially vertically upward direction;

and performing said direction-changing step outside said bath at a location spaced below the vessel opening;

said method comprising excluding any member-directing roll from immersion in said bath.

59. A method as recited in claim 58 and comprising:

enclosing and protecting said steel member from the ambient atmosphere as said strip is directed upwardly through said bottom opening of the vessel.

60. A method as recited in claim 59 and comprising:

pre-treating said steel member at a pre-treating zone located upstream of said molten coating bath;

moving said steel member along a path extending from said pre-treating zone to the bottom opening in said vessel;

and enclosing and protecting said steel member from the ambient atmosphere as the strip moves along said path.

61. A method as recited in claim 56, wherein said member is a strip and said method comprises:

maintaining the quantity of molten coating metal in said bath at less than 1,000 pounds or 454 kilograms.

62. A method as recited in claim 61 and comprising:

maintaining the quantity of molten coating metal in said bath in the range of about 67 to 500 pounds or 30 to 227 kilograms.

63. A method as recited in claim 61 and comprising:

limiting the time in which said member is immersed in said bath to no more than 1 second.

64. A method as recited in claim 56 and comprising:

limiting the time in which said member is immersed in said bath to no more than 1 second.

65. A method as recited in claim 64, wherein said coating metal is zinc, aluminum, tin, lead or alloys of each, and said method comprises:

substantially excluding from said bath any ingredient which retards alloying between said molten coating metal and the iron in said steel member.

66. A method as recited in claim 56, wherein said coating metal is zinc, aluminum, tin, lead, or alloys of each, and said method comprises:

substantially excluding from said bath any ingredient which retards alloying between said molten coating metal and the iron in said steel member.

67. A method as recited in claim 66 and comprising:

limiting the time in which said member is immersed in said bath to no more than 1 second.

68. A method as recited in claim 56 and comprising:

employing alternating current in said magnetic containment means to generate said magnetic field.

69. A method as recited in claim 68 wherein:

said magnetic field is the sole expedient for preventing said molten coating metal from escaping from the vessel through said opening.

70. A method as recited in claim 56 and comprising the additional step of replenishing said bath of molten coating metal, said replenishing step comprising:

feeding a wire composed of coating metal toward said bath, from above;

melting said wire by induction heating at a location directly above said bath;

and allowing melted coating metal from said wire to drop into said bath.

71. A method as recited in claim 56, wherein said member is a strip and said method comprises:

coating said steel strip at a commercial coating rate in the range 2.5–5 feet/second or 76–152 centimeters/second;

replenishing said bath with coating metal;

and employing said replenishing step and the bath volume to permit the normal operation of said coating method to effect a substantial change in the composition of said bath in substantially less than an hour.

72. A method as recited in claim 71 and comprising:

maintaining the quantity of molten coating metal in said bath in the range of about 67–500 pounds or 30–227 kilograms;

and employing a steel strip having a width in the range 24–72 inches 61–183 centimeters.

73. A method as recited in claim 71, wherein said replenishing step comprises:

feeding a wire composed of coating metal toward said bath, from above;

melting said wire by induction heating at a location directly above said bath;

and allowing melting coating metal from said wire to drop into said bath.

74. A method as recited in claim 56, wherein said member is a strip and said method comprises:

coating said steel strip at a commercial coating rate in the range 2.5–5 feet/second or 76–152 centimeters/second;

employing an interruptible replenishing step for replenishing said bath with coating metal;

interrupting said replenishing step;

and continuing said coating step while said replenishing step has been interrupted to deplete the volume of coating metal in said bath and to empty said vessel in a time period less than 10 minutes.

75. A method as recited in claim 74 and comprising:

providing said bath with a quantity of molten coating metal, before depletion, in the range of about 67–500 pounds or 30–227 kilograms;

and employing a steel strip having a width in the range 24–72 inches or 61–183 centimeters.

76. A method as recited in claim 56 and comprising:

pre-treating said member by induction heating at a location upstream of said bath;

employing interruptible induction heating in said pre-treating step;

interrupting said induction heating and shutting down said pre-treating step in response to a drop in demand for said coated strip;

shutting down all the other steps of said method when said pre-treating step is shut down;

and resuming said other steps and said pre-treating step in response to an increase in said demand.

77. A method as recited in claim 56, wherein said magnetic confining step is interruptible and said method comprises:

providing said vessel with a bottom interior surface which slopes toward said opening;

and emptying said bath from said vessel by interrupting said magnetic confining step.

78. A method as recited in claim 56 wherein:

said magnetic field extends from said magnetic containment means in the direction in which said member moves along said path.

79. A method as recited in claim 56 wherein said continuous steel member is a strip having a thickness and lateral and longitudinal dimensions, and wherein:

said magnetic containment means is elongated and extends longitudinally along said lateral dimension of said strip.

80. A method as recited in claim 56 wherein:

said magnetic field extends from said magnetic containments means in the direction in which said member moves along its path;

and said method comprises employing said magnetic containment means to confine said magnetic field substantially to a space at said opening between (a) that part of said magnetic containment means closest to said bath and (b) the bath at said opening. Thus, as shown in FIG. 2, bath 15 has a bottom 115 which is in contact with the top surface 51 of vessel bottom 13, but there is a gap 116 between (a) the top surface 118 of magnetic containment device 18 and (b) that part of bath bottom 115 which overlies magnetic containment device 18.

* * * * *